US011186992B2

(12) United States Patent
Jie et al.

(10) Patent No.: US 11,186,992 B2
(45) Date of Patent: Nov. 30, 2021

(54) REINFORCING STRUCTURE OF CONCRETE OVERHEAD LAYER

(71) Applicant: FENG HE YING ZAO GROUP CO., LTD., Nanchang (CN)

(72) Inventors: Baoru Jie, Nanchang (CN); Jiangang Jie, Nanchang (CN); Shuangxi Zhou, Nanchang (CN); Zhiyong Yao, Nanchang (CN); Wenrong Hu, Nanchang (CN); Yuchun Chen, Nanchang (CN); Wujin Tao, Nanchang (CN); Wen Liu, Nanchang (CN); Luolong Zhan, Nanchang (CN); Xin He, Nanchang (CN)

(73) Assignee: FENG HE YING ZAO GROUP CO., LTD., Nanchang (CN)

( * ) Notice: Subject to any disclaimer, the term of this patent is extended or adjusted under 35 U.S.C. 154(b) by 0 days.

(21) Appl. No.: 16/886,741

(22) Filed: May 28, 2020

(65) Prior Publication Data

US 2021/0095471 A1 Apr. 1, 2021

(30) Foreign Application Priority Data

Sep. 29, 2019 (CN) ..... 201921638697.X

(51) Int. Cl.

| | |
|---|---|
| ***E04C 5/16*** | (2006.01) |
| ***E04B 5/04*** | (2006.01) |
| ***E04C 5/06*** | (2006.01) |
| ***E04B 5/10*** | (2006.01) |

(52) U.S. Cl.

CPC ..... *E04C 5/163* (2013.01); *E04B 5/046* (2013.01); *E04B 5/10* (2013.01); *E04C 5/0627* (2013.01); *E04B 2103/02* (2013.01); *E04B 2103/06* (2013.01)

(58) Field of Classification Search

None

See application file for complete search history.

(56) References Cited

U.S. PATENT DOCUMENTS

| | | | | |
|---|---|---|---|---|
| 3,604,174 A * | 9/1971 | Nelson, Jr. | ..... | E04C 2/06 52/601 |
| 3,800,490 A * | 4/1974 | Conte | ..... | E04B 5/10 52/250 |
| 3,967,426 A * | 7/1976 | Ault | ..... | E04B 5/40 52/252 |
| 4,216,904 A * | 8/1980 | Vivion | ..... | E01B 9/66 238/25 |

(Continued)

*Primary Examiner* — Joshua K Ihezie

(57) ABSTRACT

The present disclosure relates to a field of construction engineering, and in particular to a reinforcing structure of a concrete overhead layer before a building expires. The reinforcing structure of the concrete overhead layer includes supporting structures, connecting structures, and metal members; wherein the reinforcing structure is configured to reinforce a concrete floor slab and/or a concrete beam; through holes are disposed on the concrete floor slab; each of the supporting structures passes through each of the through holes and the supporting structures are configured to support the concrete floor slab and/or the concrete beam; and each of the connecting structures is configured to fix each of the supporting structures on each of the metal members; each of the metal members is disposed on each of the through holes.

9 Claims, 5 Drawing Sheets

(56) References Cited

U.S. PATENT DOCUMENTS

| | | | | | |
|---|---|---|---|---|---|
| 4,442,648 | A * | 4/1984 | Reece | E04C 2/044 | 29/460 |
| 4,603,522 | A * | 8/1986 | Johnson | E04B 1/04 | 52/125.4 |
| 4,750,306 | A * | 6/1988 | Granieri | E02D 27/50 | 52/251 |
| 4,885,884 | A * | 12/1989 | Schilger | E04B 5/04 | 52/354 |
| 4,893,784 | A * | 1/1990 | Abraham | E02D 37/00 | 254/100 |
| 5,311,629 | A * | 5/1994 | Smith | E01D 22/00 | 14/73.1 |
| 5,802,652 | A * | 9/1998 | Smith | E01D 19/125 | 14/73 |
| 6,904,636 | B2 * | 6/2005 | Hwang | E01D 19/125 | 14/73 |
| 8,397,442 | B2 * | 3/2013 | Laurin | E02D 27/32 | 52/126.6 |
| 2003/0230039 | A1 * | 12/2003 | Rizzotto | E04B 1/34352 | 52/295 |
| 2006/0216117 | A1 * | 9/2006 | Peterson | E02D 35/00 | 405/230 |
| 2008/0157046 | A1 * | 7/2008 | Murphy | E04G 21/3261 | 256/32 |
| 2014/0298749 | A1 * | 10/2014 | Manning | E04C 3/293 | 52/649.2 |
| 2019/0360221 | A1 * | 11/2019 | Gantt | E04G 23/0229 | |

* cited by examiner

REINFORCING STRUCTURE OF CONCRETE OVERHEAD LAYER

TECHNICAL FIELD

The present disclosure relates to a field of construction engineering, and in particular to a reinforcing structure of a concrete overhead layer before a building expires.

BACKGROUND

According to the determination of the international concrete agency, design service life grade of concrete is divided into three grades: the design service life of the first grade is 100 years, the design service life of the second grade is 60 years, and the design service life of the third grade is 30 years. Area of new houses in China exceeds 2 billion square meter each year, accounting for more than 50% of the world. There are also a large number of concrete dams, bridges and other projects underway. How to extend the service life of concrete is a major issue facing mankind. If cohesive structures that have reached the end of their service life must be completely removed, it would be a catastrophic task, which not only wastes concrete resources, but also wastes manpower and material resources. A large amount of construction waste harms living environment of humans, and moreover, a lot of dust generated during a demolition process, causes great pollution to the environment.

SUMMARY

An object of the present disclosure is to solve problems in the prior art, and to provide a reinforcing structure of a concrete overhead layer before s building expires, which greatly improves a service life of concrete structures without changing original function of the building.

To achieve the above object, the present disclosure provides a reinforcing structure of a concrete overhead layer. The reinforcing structure of the concrete overhead layer includes supporting structures, connecting structures, and metal members. The reinforcing structure is configured to reinforce a concrete floor slab and/or a concrete beam. Through holes are disposed on the concrete floor slab. Each of the supporting structures passes through each of the through holes and the supporting structures are configured to support the concrete floor slab and/or the concrete beam. And each of the connecting structures is configured to fix each of the supporting structures on each of the metal members. Each of the metal members is disposed on each of the through holes.

Furthermore, the supporting structures are metal supporting plates. The metal supporting plates are metal flat plates. Each of the connecting structures comprises a metal base and metal clamps. Each metal base is fixed on each of the metal supporting plates. Each metal base comprises a first through hole. And an axial direction of each first through hole is same as a horizontal direction of the corresponding metal supporting plate. A second through hole is disposed on one end of each of the metal clamps, and outer threads are disposed on another end of each of the metal clamps. The first through hole is connected with the second through holes via a first bolt. The another end of each of the metal clamps is connected with each of the metal members via the outer threads to reinforce the concrete floor slab.

Furthermore, a steel pipe pad is sleeved into the first through hole to facilitate a rotation of the metal clamps relative to each metal base.

Furthermore, the through holes are cross double-type holes. A center of each of the through holes is circular. Length and width of each of the metal supporting plates is greater than a circular diameter of the center of each of the through holes and no more than an outer diameter of each of the through holes.

Furthermore, each of the supporting structures is a pair of L-shaped metal hooks. Each pair of the L shaped metal hooks is oppositely disposed; each horizontal end of the L-shaped metal hooks is disposed on a bottom portion of the concrete beam; and a length of each horizontal end of the L-shaped metal hooks is not less than half of a width of the concrete beam. Vertical ends of each pair of the L-shaped metal hooks pass through each of the through holes. A hole is disposed on an upper portion of each of the L-shaped metal hooks. The connecting structures are second bolts. And each hole of each of the L-shaped metal hooks is fixedly connected with each of the metal members via the second bolts to make each pair of the L-shaped metal hooks connect with each of the metal members to reinforce the concrete beam.

Furthermore, a steel washer is sleeved on each of the second bolts and each steel washer is disposed between each of the second bolts and each of the L-shaped metal hooks.

Furthermore, the metal members are evenly disposed in horizontal and vertical directions of the concrete floor slab.

Furthermore, the metal members are steel I-beams.

Furthermore, gaps of the through holes are filled with high-strength fine stone concrete.

Furthermore, the supporting structures, the connecting structures, and the metal members are made of corrosion-resistant metal material.

The reinforcing structure of the concrete overhead layer is made of corrosion-resistant metal material, which is configured to reinforce concrete structures of buildings and greatly improves a service life of the concrete structures and form a new performance composite structure. Without changing the original functions of the buildings, corrosion-resistant structures of the present disclosure realize an organic combination with the concrete structures, which extends the service life of the concrete buildings and protects the environment.

1. metal pallet; 2. L shaped metal hook; 3. steel I-beam; 4. metal floor plate; 5. metal supporting plate; 6. first bolt; 7. metal clamp; 8. metal base; 9. steel pipe pad; 10. steel washer; 11. high-strength fine stone concrete; 12. second bolt; 13 cross double-type hole; 20. hole; 100. concrete floor slab; and 200. concrete beam.

DETAILED DESCRIPTION

It should be noted that in this embodiment, the directional words "up, down, top, and bottom" are all described according to the drawings, and do not constitute a limitation of the present disclosure.

Figure 1:
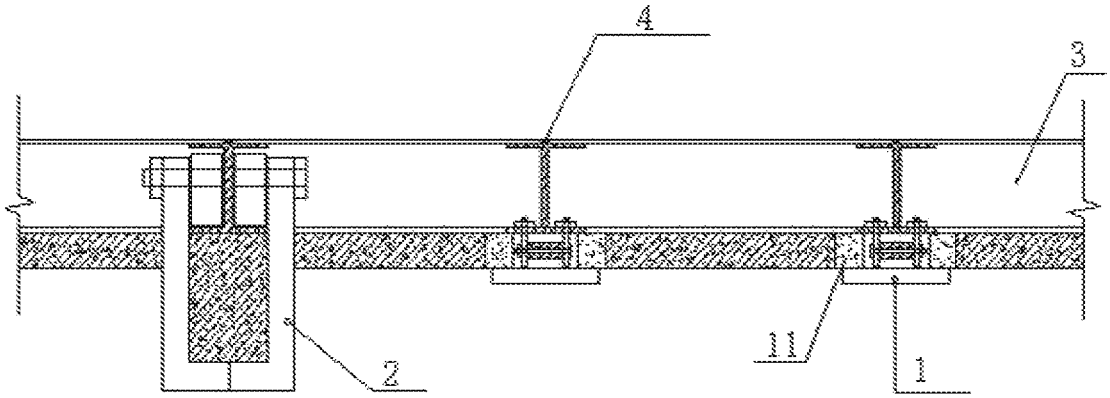
FIG. 1 is a schematic view showing a structure of one embodiment of the present disclosure.
Figure 2:
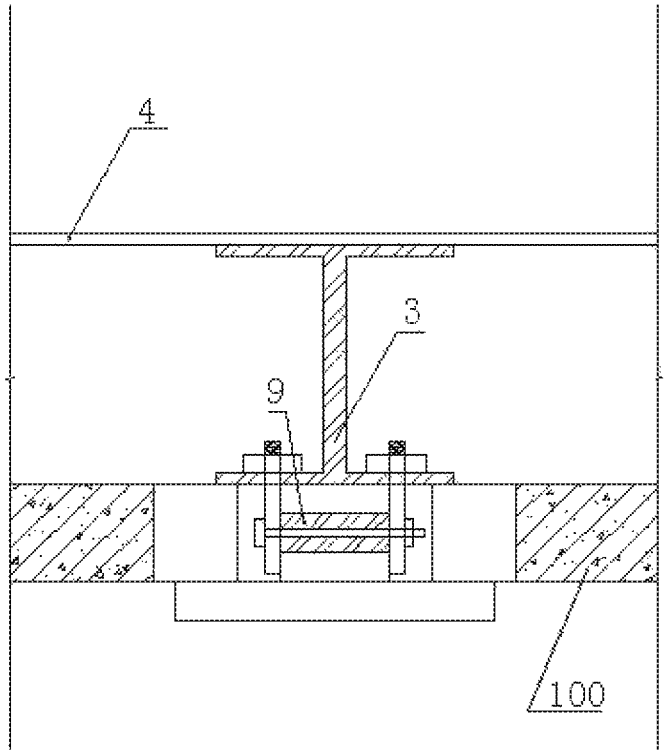
FIG. 2 is a schematic structural diagram of a reinforcement structure of a concrete slab shown in FIG. 1.
Figure 3:
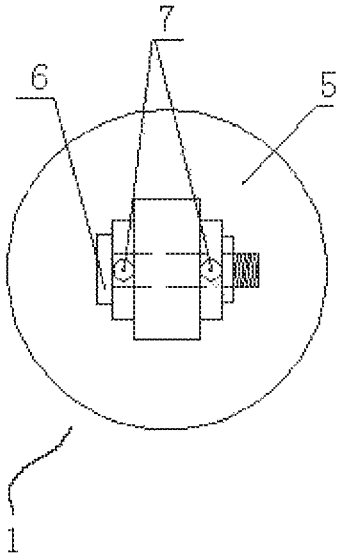
FIG. 3 is a schematic structural diagram of a metal pallet shown in FIG. 2.
Figure 4:
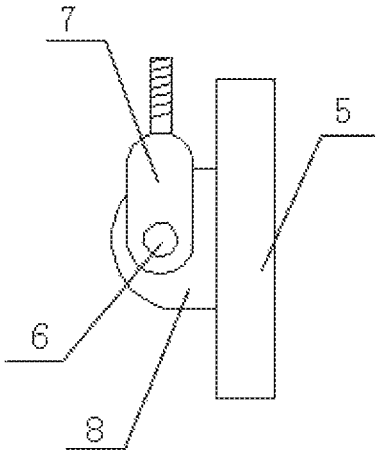
FIG. 4 is a schematic structural diagram of a metal supporting plates shown in FIG. 2.

The present disclosure will be further described in detail below with reference to FIGS. 1-7: The present disclosure provides a reinforcing structure of a concrete overhead layer configured to reinforce a concrete floor slab 100 and/or a concrete beam 200. As shown in FIG. 1, through holes are disposed on the concrete floor slab 100. Corrosion-resistant steel I-beams 3 are disposed on the through holes and are evenly arranged in a X direction (e.g., a horizontal direction) and a Y direction (e.g., a vertical direction) of the concrete floor slab 100. Connecting structures of the concrete floor slab 100 and connecting structures of the concrete beam 200 are fixed on the corrosion-resistant steel I-beams 3. Metal floor plates 4 are laid on the corrosion-resistant steel I-beams 3. Furthermore, gaps of the through holes are filled with high-strength fine stone concrete 11.

As shown in FIGS. 2-5, reinforcing structures of the concrete floor slab 100 are metal pallets 1. The metal pallets 1 comprise metal supporting plates 5, metal base 8, and metal clamps 7. The metal supporting plates 5 are circular metal flat plates. Each metal base 8 is fixedly welded on each of the metal supporting plates 5. Each metal base 8 comprises a first through hole. And an axial direction of each first through hole is same as a horizontal direction of the corresponding metal supporting plate 5. A second through hole is disposed on one end of each of the metal clamps 7, and outer threads are disposed on another end of each of the metal clamps 7. Each two metal clamps are symmetrically disposed on an outside of each metal base 8. Each metal base 8 is connected with each two metal clamps 7 by a first bolt 6 passing through the corresponding first through holes and the corresponding two second through holes, so that the metal base 8 is limited by the metal clamps 7. Each two metal clamps 7 are connected with each of corrosion-resistant steel I-beams 3 by outer threads disposed on another ends of each two of the metal clamps 7, so that the metal supporting plates 5 are closely attached to a lower surface of the concrete floor slab 100 to reinforce the concrete floor slab.

Figure 5:
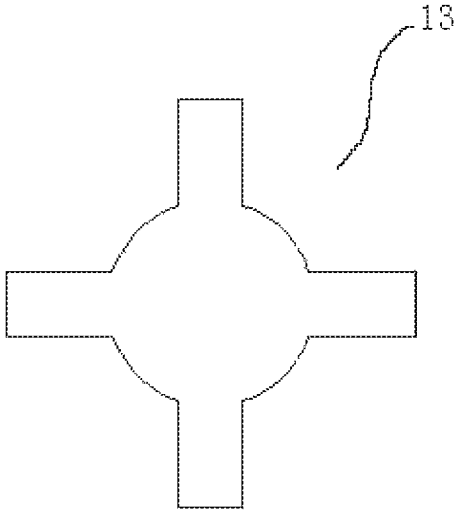
FIG. 5 is a schematic structural diagram of a through hole shown in FIG. 2.

As shown in FIG. 5, in order to facilitate each metal tray 1 to pass through each of the through holes from top to bottom, each of the through holes is a cross double-type hole 13. A center of each of the through holes is circular. Length and width of each of the metal supporting plates is greater than a circular diameter of the center of each of the through holes and no more than an outer diameter of each of the through holes. A steel pipe pad 9 is sleeved into each of the first through holes to facilitate a rotation of the metal clamps 7 relative to each metal base 8. Each first bolt 6 passes through each two of the second through holes and each steel pipe pad 9 to fix each of the metal supporting plates 5 together with each metal base 8. When each of the metal trays 1 needs to pass through each cross double-type hole 13 from top to bottom, each two metal clamps 7 are rotated by a certain angle, so that each of the metal trays 1 is able to quickly pass through each cross double-type hole 13.

Figure 6:
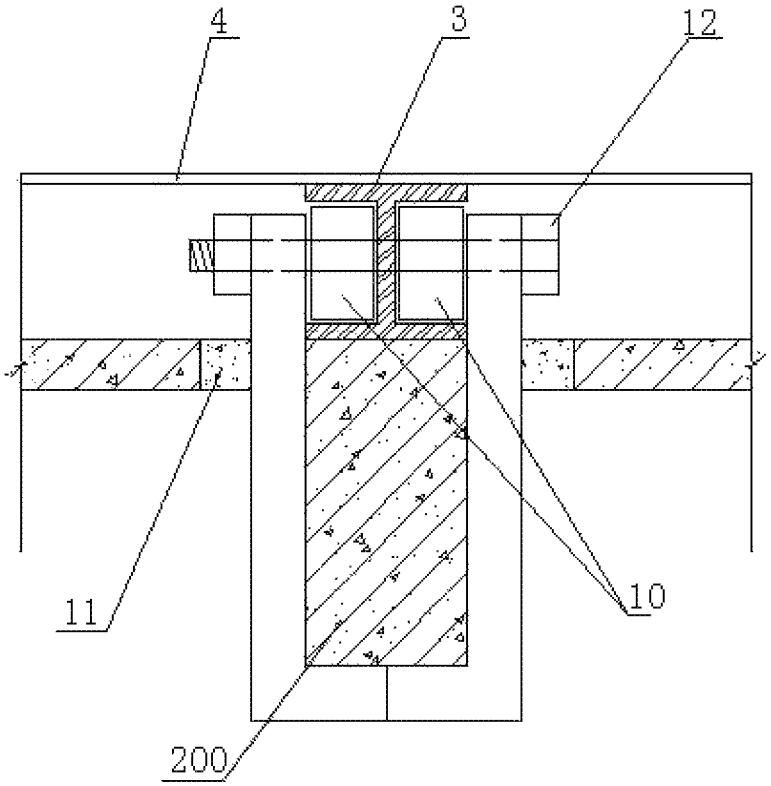
FIG. 6 is a schematic structural diagram of a reinforcement structure of a concrete steam shown in FIG. 1.
Figure 7:
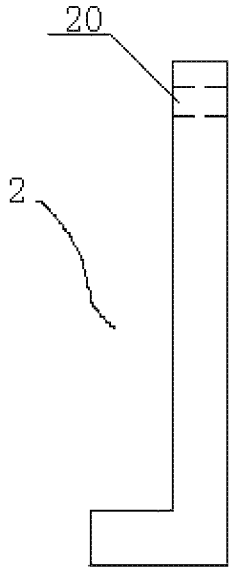
FIG. 7 is a schematic structural diagram of metal hooks shown in FIG. 6.

As shown in FIGS. 6-7, each reinforcing structure of concrete beam 200 comprises a pair of L-shaped metal hooks 2 and corrosion-resistant second bolts 12. Each pair of the L shaped metal hooks 2 is oppositely disposed. Each horizontal end of the L-shaped metal hooks is disposed on a bottom portion of the concrete beam 200; and a length of each horizontal end of the L-shaped metal hooks 2 is not less than half of a width of the concrete beam. Vertical ends of each pair of the L-shaped metal hooks 2 pass through each of the through holes. A hole 20 is disposed on an upper portion of each of the L-shaped metal hooks 2. And each hole 20 of each of the L-shaped metal hooks 2 is fixedly connected with each of the steel I-beams 3 via the corrosion-resistant second bolts 12 to make each pair of the L-shaped metal hooks 2 connect with each of the steel I-beams 3 to reinforce the concrete beam 200.

In order to reinforce the concrete beam 200, steel washers 10 are disposed on both two sides of the steel I-beams 3, that is, each steel washer 10 is sleeved on each of the corrosion-resistant second bolts 12 and each steel washer 10 is disposed between each of the corrosion-resistant second bolts 12 and each of the L-shaped metal hooks 2 to prevent the L-shaped metal hooks 2 from deformation.

To prevent the reinforcing structure from decay, the reinforcing structure of the concrete overhead layer is made of corrosion-resistant metal material.

When reinforcing the concrete floor slab 100, the concrete floor 100 is cut to obtain the cross double-type holes, then each of the metal trays 1 is controlled to pass through each of the cross double-type holes. The metal trays 1 are fixed to the steel I-beams 3 disposed on the through holes and evenly disposed in x and y directions of the concrete floor slab 100 by the first bolts 6. After the metal trays 1 are installed, the through holes are filled with high-strength fine stone concrete 11. Thus, several metal trays 1 support the original concrete floor slab 100 to form an overall reinforcement system. The metal floor plates 4 are fixed on the corrosion-resistant steel I-beams 3 by corrosion-resistant flat head bolts When reinforcing the concrete beams, the corrosion-resistant steel I-beams 3 are disposed on the concrete beams 200, and a rectangular hole is cut on the concrete floor slab close to each concrete beam, and each pair of the L-shaped metal hooks 2 pass through each rectangular hole to support each of the concrete beams. And the L-shaped metal hooks 2 are installed on the corrosion-resistant steel I-beams 3 by the corrosion-resistant second bolts 12. Several L-shaped metal hooks 2 form the overall reinforcement system.

The above-mentioned embodiments are only optional implementations of the present disclosure and do not constitute limitations on the present disclosure. Those ordinary skilled in the art should understand that any modifications and extensions made without departing from the present disclosure are within the protection scope of the present disclosure.

What is claimed is:

1. A reinforcing structure of a concrete overhead layer, comprising supporting structures, connecting structures, and metal members; wherein the reinforcing structure is configured to reinforce a concrete floor slab and/or a concrete beam; through holes are disposed on the concrete floor slab; each of the supporting structures passes through each of the through holes and the supporting structures are configured to support the concrete floor slab and/or the concrete beam; and each of the connecting structures is configured to fix each of the supporting structures on each of the metal members; each of the metal members is disposed on each of the through holes;

wherein the supporting structures are metal supporting plates, the metal supporting plates are metal flat plates;

each of the connecting structures comprises a metal base and metal clamps; each metal base is fixed on each of the metal supporting plates; each metal base comprises a first through hole; and an axial direction of the first through hole is same as a horizontal direction of the corresponding metal supporting plate; a second through hole is disposed on one end of each of the metal clamps; and outer threads are disposed on another end of each of the metal clamps; the first through hole is connected with the second through holes via a first bolt; the another end of each of the metal clamps is connected with each of the metal members via the outer threads to reinforce the concrete floor slab.

2. The reinforcing structure of the concrete overhead layer according to claim 1, wherein a steel pipe pad is sleeved into the first through hole to facilitate a rotation of the metal clamps relative to each metal base.

3. The reinforcing structure of the concrete overhead layer according to claim 1, wherein the through holes are cross double-type holes, a center of each of the through holes is circular, length and width of each of the metal supporting plates is greater than a circular diameter of the center of each of the through holes and no more than an outer diameter of each of the through holes.

4. The reinforcing structure of the concrete overhead layer according to claim 1, wherein the metal members are evenly disposed in horizontal and vertical directions of the concrete floor slab.

5. The reinforcing structure of the concrete overhead layer according to claim 1, wherein the metal members are steel I-beams.

6. The reinforcing structure of the concrete overhead layer according to claim 1, wherein gaps of the through holes are filled with high-strength fine stone concrete.

7. The reinforcing structure of the concrete overhead layer according to claim 1, wherein the supporting structures, the connecting structures, and the metal members are made of corrosion-resistant metal material.

8. A reinforcing structure of a concrete overhead layer, comprising supporting structures, connecting structures, and metal members; wherein the reinforcing structure is configured to reinforce a concrete floor slab and/or a concrete beam; through holes are disposed on the concrete floor slab; each of the supporting structures passes through each of the through holes and the supporting structures are configured to support the concrete floor slab and/or the concrete beam; and each of the connecting structures is configured to fix each of the supporting structures on each of the metal members; each of the metal members is disposed on each of the through holes;

wherein each of the supporting structures is a pair of L-shaped metal hooks; each pair of the L shaped metal hooks is oppositely disposed; each horizontal end of the L-shaped metal hooks is disposed on a bottom portion of the concrete beam; and a length of each horizontal end of the L-shaped metal hooks is not less than half of a width of the concrete beam; vertical ends of each pair of the L-shaped metal hooks pass through each of the through holes; a hole is disposed on an upper portion of each of the L-shaped metal hooks; the connecting structures are second bolts, and each hole of each of the L-shaped metal hooks is fixedly connected with each of the metal members via the second bolts to make each pair of the L-shaped metal hooks connect with each of the metal members to reinforce the concrete beam.

9. The reinforcing structure of the concrete overhead layer according to claim 8, wherein a steel washer is sleeved on each of the second bolts and each steel washer is disposed between each of the second bolts and each of the L-shaped metal hooks.

* * * * *